United States Patent [19]

Ishikawa et al.

[11] Patent Number: 4,909,319

[45] Date of Patent: Mar. 20, 1990

[54] HEAT EXCHANGER

[75] Inventors: Atuyumi Ishikawa, Ohta; Takeshi Kanai; Hirofumi Iinuma, both of Gunma, all of Japan

[73] Assignee: Sanyo Electric Co., Ltd., Osaka, Japan

[21] Appl. No.: 299,565

[22] Filed: Jan. 18, 1989

[30] Foreign Application Priority Data

Jun. 9, 1988 [JP] Japan ..... 63-142432

[51] Int. Cl.[4] ..... F28D 1/04

[52] U.S. Cl. ..... 165/151

[58] Field of Search ..... 165/151, 152

[56] References Cited

U.S. PATENT DOCUMENTS 4,691,767 9/1987 Tanaka ..... 165/151

FOREIGN PATENT DOCUMENTS 58-49503 11/1983 Japan .

63-11597 3/1988 Japan .

*Primary Examiner*—Robert G. Nilson

*Attorney, Agent, or Firm*—Wenderoth, Lind & Ponack

[57] ABSTRACT

A heat exchanger having an improved and substantially uniform heat exchange efficiency, provided with a plurality of plate fins each of which has tube inserting bores arranged in a staggered manner, and heat transfer tubes inserted through these bores, a plurality of each of the fins which are between the tubes being cut doubly to a small width and raised so as to form louver elements so that the louver elements cross a flow of the air stream. The root portions of the louver elements are positioned so as to surround the inserted portions of the tubes, the louver elements consisting of central louver elements formed on both sides of the center line of the row of the tubes, and a plurality of rows of divisional louver elements formed on both sides of the central louver elements with base portions left on the regions of the fin which are on a line crossing the mentioned center line, and the length of the divisional louver elements in the outside rows farthest away from the center line is set substantially equal to the distance between the louver elements in each row and the length of the divisional louver elements in the inside rows.

9 Claims, 5 Drawing Sheets

HEAT EXCHANGER

BACKGROUND OF THE INVENTION

The present invention relates to a plate fin type heat exchanger to be installed in an air-conditioner.

In order to improve the heat exchange efficiency of a plate fin type heat exchanger, a plurality of portions of each plate fin are cut to a small width and raised in the shape of bridges projecting in a direction which crosses the direction of a flow of an air stream, as disclosed in Japanese Patent Publication No. 63-11597/1988, or a plurality of portions of each plate fin is cut to a small width and raised so as to form a louver each slat of which project in a direction which crosses the direction of a flow of an air stream, as disclosed in Japanese Utility model Publication No. 58-49503/1983.

When the air stream flows at right angles to the surfaces of the plate fins in the heat exchanger disclosed in the above Japanese Patent Publication No. 33-11597/1988, it passes the cut and raised portions constituting the louver elements of a larger air resistance and the non-cut base portions of a smaller air resistance alternately, so that the air resistances of all parts of the interior of the heat exchanger become substantially equal to cause the heat exchange efficiency to be improved. In, for example, a wall type air-conditioner, which is mounted on a wall surface of a room, a cross flow fan is provided at the back of a lower portion of a longitudinally elongated heat exchanger body. Therefore, the air stream flows in the diagonally downward direction in the upper half portion of the interior of the heat exchanger and passes all of the louver elements of a larger air resistance. In addition, the velocity of this air stream is originally lower than that of the air stream flowing in the lower half portion of the interior of the heat exchanger. Consequently, if the rotational speed of the cross flow fan is increased for the purpose of improving the heat exchange efficiency in the upper half portion of the heat exchanger, there is the possibility that the velocity of flow of the air stream flowing in the substantially horizontal direction in the lower half portion of the interior of the heat exchanger will increase causing noise to occur when the air stream passes through the spaces among the plate fins.

In the heat exchanger disclosed in the above Japanese Utility Model Publication No. 58-49503/1983, the root portions of the louver elements are positioned around the portions of each fin which surround the heat transfer tubes so that the greater part of the air stream passes the louver elements provided in rows over the whole width of the heat exchanger. Also, the louver elements in the outside rows which are farthest away from the center line of a row of heat transfer tubes, and the louver elements in the inside rows are divided, and the lengths of these divisional louver elements are reduced, whereby the heat transfer paths between the louver elements and the base portion of the fin are shortened to enable the heat exchange efficiency to be improved. However, in spite of the fact that the louver elements in the outside rows are farthest away from the center line of the heat transfer tubes and have a low heat transfer rate, the length thereof is larger than that of the louver elements in the inside rows, so that the heat transfer efficiency of the louver elements in the outside rows does not become sufficiently high. Therefore, when this heat exchanger is installed in a wall type air-conditioner, the air stream flows in the diagonally downward direction in the upper half portion of the interior of the heat exchanger and passes all of the louver elements of a larger air resistance, and the velocity of flow of this air stream is originally lower than that of the air stream flowing in the lower half portion of the interior of the heat exchanger, as in the heat exchanger disclosed in the above Japanese patent Publication No. 63-11597/1988. Accordingly, there is the possibility that, if the rotational speed of the cross flow fan is increased, noise will be generated.

SUMMARY OF THE INVENTION

An object of the preset invention is to provide a heat exchanger in which the louver elements are arranged so that the resistance to the air stream flowing diagonally across the heat exchanger becomes lower than that to the air stream flowing horizontally across the heat exchanger, and to provide an air-conditioner provided with this heat exchanger, which have been developed in view of the above-mentioned problems.

Another object of the present invention is to provide a heat exchanger in which louver elements and projections are arranged so that the resistance to the air stream flowing diagonally crossing the heat exchanger becomes lower than that to the air stream flowing horizontally across the heat exchanger.

To achieve the above object, the present invention provides a heat exchanger having a plurality of plate fins in each of which tube inserting bores are arranged in a staggered manner, and heat transfer tubes are inserted through these bores, a plurality of portions of each of the fins which are between the tubes being cut doubly to a small width and raised so as to form louver elements projecting in a direction which crosses the direction of a flow of the air stream. The root portions of the louver elements are positioned in the portions of each plate fin which are around the outer surfaces of the inserted portions of the heat transfer tubes, the louver elements consisting of central louver elements provided close to the center line of a row of heat transfer tubes, and a plurality of rows of divisional louver elements provided on the right and left sides of the central louver elements with base portions left on the regions of the plate fin which are on a line crossing the mentioned center line. The length of the divisional louver elements in the outside rows farthest away from the center line, is set substantially equal to the distance between these louver elements in each row and the length of the divisional louver elements in the inside row closer to the center line than the outside rows.

It is preferable in this heat exchanger to arrange the central louver elements and divisional louver elements symmetrically with respect to a bisector extending at right angles to the center line of the heat transfer tubes, set the distance between the divisional louver elements in the outside rows provided between adjacent tubes in the same tube row smaller than the distance between the divisional louver elements in the outer outside rows adjacent tube in the adjacent tube row, and form such louver elements on both sides of each plate fin.

The plate fin in this heat exchanger is provided with recesses formed by cutting the plate fin with the divisional louver elements in the outside rows, these recesses being formed so that the recesses stunt the tube inserting bores.

The edge portions of the plate fin that face the recesses are bent at least in a direction crossing the direction of a flow of the air stream, and the length of the bent portions is set preferably smaller than the pitch of the plate fins.

In an embodiment of the present invention, a plurality of projections are provided so that each of the projections projects across the air stream flowing direction, at an edge portion of the plate fin opposed to the base portion of the plate fins of the divisional louver elements in the outside rows.

In the heat exchanger according to the present invention, a plurality of rows of divisional louver elements of a substantially equal length are arranged linearly in the diagonally downward directions on both sides of the central louver elements close to the heat transfer tubes in the same tube row. Accordingly, in an upstream tube row section, an air stream $W_1$ flowing from the diagonally upper side of a fin into the upper divisional lower element in one outer row advances linearly in the diagonally downward direction along the upper divisional louver elements in one inside row, the central louver elements, the lower divisional louver element in the other inside row and the lower divisional louver element in the other outside row in the mentioned order. The air stream then flows into the louver elements in the downstream tube row section and advances through the space between the divisional louver elements in the upstream outer row along the surface of the plate fin, the air stream further flowing in two streams one of which flows through the lower divisional louver element in the upstream inside row, and the other of which flows through the space between this louver element and the divisional louver element above the same, to the central louver elements and then along the upper side of a heat transfer tube immediately below this tube. The air stream $W_1$ thus passes through the heat exchanger.

In the pace in the upstream tube row section, an air stream $W_2$ flowing from the diagonally upper side of the fin into the space between the divisional louver elements in the outside row advances in two streams from the lower divisional louver element in the upstream inner row and the space between this louver element and the divisional louver element just above the same to the central louver elements, and then along the upper surface of the heat transfer tube. The air stream then flows into the space in the downstream tube row section, and advances from the space between the divisional louver elements in the outside row to the inner side of the lower divisional louver element in the downstream inside row and thereafter along the upper surface of the heat transfer tube. The air stream $W_2$ thus passes through the heat exchanger.

In the space in the upstream tube row section, an air stream $W_3$ flowing from the diagonally upper side of the fin into the lower divisional louver element in the upstream outer row advances along the upper an lower surfaces of the heat transfer tube. The air stream flowing along the upper surface of the tube advances between the divisional louver elements in the downstream outside row, while the air stream flowing along the lower surface of the tube advances through the upper divisional louver element in the downstream inside row to separate into two minor streams one of which flows through the upper divisional louver element in the outer row, and the other of which flows between this louver element and the divisional louver element just below the same. Out of these two major air streams thereafter flowing into the space in the downstream tube row section, the air stream flowing through the lower divisional louver element in the outside row advances along the lower surface of the heat transfer tube, through the upper louver element in the downstream inside row and then between the divisional louver elements in the downstream outside row. The other air stream advances between the divisional louver elements in the outside row, along the lower surface of the heat transfer tube in the adjacent row, through the central louver elements, between the divisional louver elements in the downstream inside row, and then between the divisional louver elements in the downstream outside row. The air stream $W_3$ thus passes through the heat exchanger.

In the embodiment incorporating projections in addition to the louver elements, the air stream $W_3$ passing between the divisional louver elements in the down stream outside row passes along the root portions of the projections.

In the space in the upstream tube row section, an air stream $W_4$ flowing into the heat exchanger along the base portion of the surface of a plate fin advances along the lower surface of this heat transfer tube and through the central louver elements to separate into two streams one of which flows through the upper divisional louver element in the downstream inside row, and the other of which flows between this louver element and the divisional louver element just below the same, the air stream thereafter flowing between the divisional louver elements in the downstream outside row. The air stream then flows into the space in the downstream tube row section and advances linearly in the diagonally downward direction from the upper divisional louver element in the upstream outside row to the lower divisional louver element in the downstream outside row via the upper divisional louver element in the upstream inside row, the central louver elements and the lower divisional louver element in the downstream inside row, all of which louver elements are arranged linearly in the diagonally downward direction with the central louver elements in the intermediate position. The air stream $W_4$ thus passes through the heat exchanger.

In the space in the upstream tube row section, an air stream $W_5$ flowing into the upper divisional louver element in the upstream outside row in the horizontal direction advances through the upper divisional louver elements in the inside row, the central louver elements, the upper divisional louver element in the downstream inside row, and the upper divisional louver element in the downstream outer row in the mentioned order. The air stream then flows into the space in the downstream tube row section and advances through the lower divisional louver element in the outside row, the lower divisional louver element in the inside row, the central louver elements, the lower divisional louver element in the downstream inside row and the lower divisional louver element in the downstream outside row in the mentioned order. The air stream $W_5$ thus passes through the heat exchanger in a meandering manner.

In the space in the upstream tube row section, an air stream $W_6$ flowing into the space between the divisional louver elements in the outer row in the horizontal direction separates into streams at the root portions of the divisional louver elements in the inside row, advances through the central louver elements, separates again into streams at the root portions of the divisional louver elements in the downstream inside row and flows between the divisional louver element in the downstream outside row. The air stream thereafter flows into the space between the divisional louver elements in the outside row provided between two adjacent tubes in the downstream tube row section as the distance between the streams decreases, and the air stream then separates into air streams which flow along the upper and lower surfaces of the tube in the downstream row. The air stream $W_6$ thus passes through the heat exchanger in a meandeiing manner.

In the space in the upstream tube row section, an air stream $W_7$ flowing into the divisional lower louver element in the outside row in the horizontal direction advances so that the locus of the flow of this air stream has a vertically symmetric relation with that of the flow of the above-mentioned air stream $W_5$. An air stream $W_8$ flowing into the heat exchanger along the portion of the surface of the base region of the plate fin which is on the outer side of the tube in the upstream row advances so that the locus of the flow of this air stream has a horizontally reversed symmetric relation with that of the flow of the above-mentioned air stream $W_6$. These air streams $W_7$, $W_8$ thus pass through the heat exchanger in a meandering manner.

In the embodiment of the invention incorporating projections in addition to the louver elements projecting in a direction which crosses the direction of a flow of the air stream , the air stream $W_8$ passes in a meandering manner through the heat exchanger in a horizontally reversed symmetric relation with the air stream $W_6$, and is "rectified" by the projections at the flow-out portion, which means that the meandering air stream $W_8$ is regulated by the projections. The above and other objects as well as advantageous features of the invention will become apparent from the following description of the preferred embodiment taken in conjunction with the accompanying drawings.

BRIEF DESCRIPTION OF THE DRAWINGS

The accompanying drawings show various embodiments of the present invention, wherein.

DESCRIPTION OF THE PREFERRED EMBODIMENTS

Figure 1:
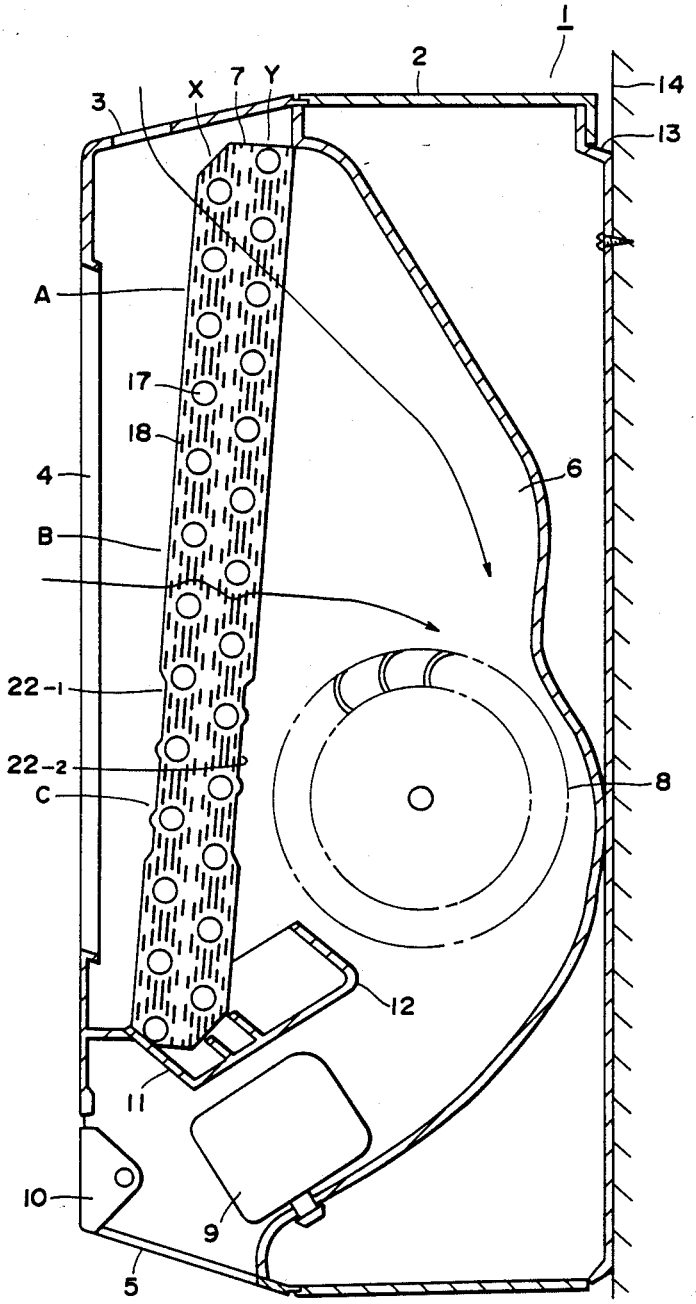
FIG. 1 is a longitudinal section of an air conditioner.
Figure 2:
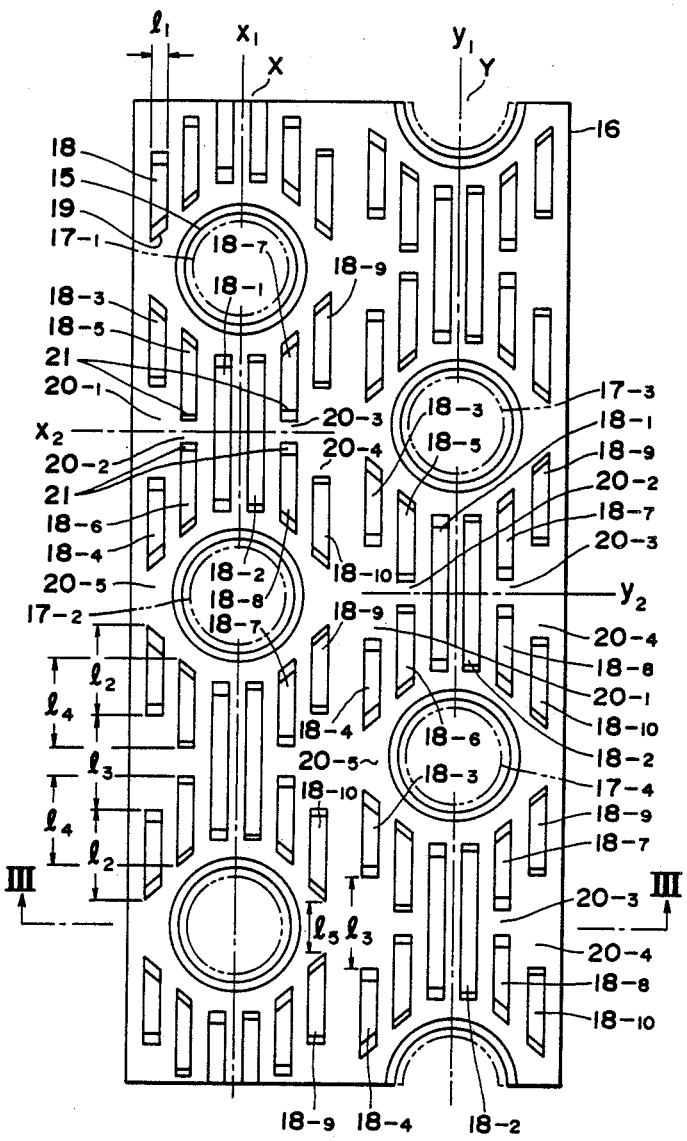
FIG. 2 is an enlarged view of a principal portion of a heat exchanger.

An embodiment of the present invention will now be described with reference to the drawings. Referring to FIG. 1, an air-conditioner generally indicated at 1 has air suction ports 3, 4 in the upper and front walls of a cabinet 2, and an air discharge port 5 in the front portion of a lower wall thereof, and is provided with a heat exchanger 7 and a cross flow fan 8 in an air flow passage 6 which is communicated with these air suction ports 3, 4 and air discharge port 5. The air sucked from the air suction portion 3 in the upper wall of the cabinet 2 passes through the heat exchanger 7 in the diagonally downward direction, and the air sucked from the air suction port 4 in the central portion of the front wall thereof passes therethrough in the substantially horizontal direction, as shown by a solid line, respectively. These air currents are then sent under pressure by the cross flow fan 8 and blown off from the discharge port 5. A vertical blade 9 for changing the direction of the air to be blown off in the lateral direction, and a lateral blade 10 for changing the direction of the air to be blown off in the vertical direction are provided. A drain pan 11 which is adapted to receive the drain occurring in the heat exchanger 7, and which is provided with a stabilizer 12, which is formed integrally with the drain pan, for the cross flow fan 8, and a mounting plate 13 for use in fixing the air-conditioner 1 to a wall 14 of a room are provided.

With reference to FIGS. 2–7, the heat exchanger 7 is provided with a plurality of plate fins 16 in each of which tube inserting bores 15 are arranged in a staggered manner, and heat transfer tubes 17 are inserted through the bores 15. The portion of a plate fin 16 which is between the heat transfer tubes 17-1, 17-2 and the portion of the plate fin 16 which is between the heat transfer tubes 17-3, 17-4 are cut in a direction which crosses the direction of a flow of the air stream, and the cut portions of the fin are raised alternately to the shape of bridges to a plurality of narrow louver elements 18 of a width ($l_1$) on both surfaces of the plate fin 16.

The root portions 19, at which the louver elements 18 start and are raised, of the louver elements 18 are positioned along the outer surface to the heat transfer tube 17, and these louver elements 18 above central louvers 18-1, 18-2 of the same length provided on both sides of each of the center lines $X_1$, $Y_1$ of the heat transfer tubes 17-1, 17-2, 17-3, 17-4, and a plurality of rows of divisional louver elements 18-3, 18-4, 18-5, 18-6, 18-7, 18-8, 18-9, 18-10 provided on both sides of the central louver elements 18-1, 18-2 and divided with the base portions 20-1, 20-2, 20-3, 20-4 of the plate fin 16 left therebetween on bisectors $X_2$, $Y_2$ crossing the center lines $X_1$, $Y_1$ at right angles thereto. Between adjacent tubes in the same row, the length $l_2$ of the divisional louver elements 18-3, 18-4, 18-9, 18-10 in the outside rows farthest away from the center lines $X_1$, $Y_1$ the distance $l_3$ between these divisional louver elements in the same row, and the length $l_4$ of the divisional louver elements 18-5, 18-6, 18-7, 18-8 in the inside rows closer to the center lines $X_1$, $Y_1$ than the outside louver elements 18-3, 18-4, 18-9, 18-10 are set substantially equal.

The central louver elements 18-1, 18-2 and the divisional louver elements 18-3, 18-4, 18-5, 18-6, 18-7, 18-8, 18-9, 18-10 are arranged symmetrically with respect to the bisectors $X_2$, $Y_2$ crossing the center lines $X_1$, $Y_1$ at right angles thereto. The distance $l_5$ between the divisional louver elements 18-9, 18-10 in the outside row and provided between adjacent tubes in the same tube row is set smaller than the distance $l_3$ between the divisional louver elements 18-3, 18-4 in the outside row and provided between adjacent tubes in the adjacent tube row.

Figure 7:
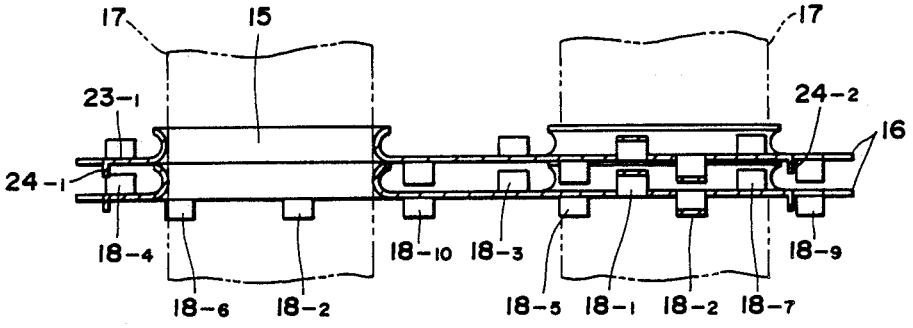
FIG. 7 is a sectional view taken along the line VII—VII in FIG. 6.
Figure 8:
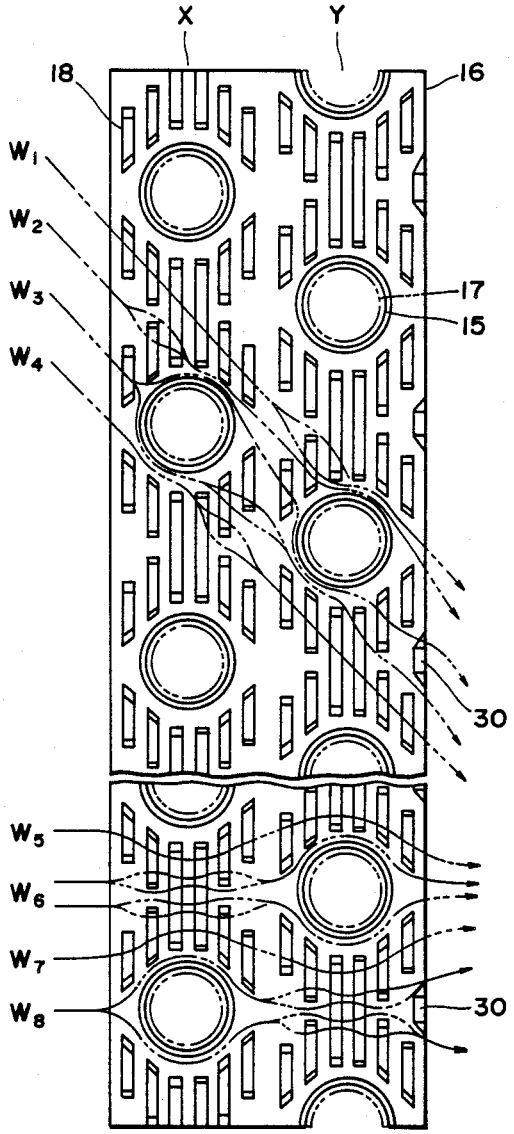
FIG. 8 is an enlarged view of an upper and central portion of the heat exchanger according to another embodiment of the invention.

In another embodiment of the invention shown in FIG. 8, a plurality of projections 30 are provided at a flow-out end portion of the plate fin 16 (FIG. 7), the flow-out end portion being opposed to the base portions 20-4 between the divisional louver elements 18-9, 18-10, in such a manner that the projections 30 project slightly longer than the length of the space between the adjacent plate fins 16 in the direction which crosses the flow of the air stream. The projections 30 can be formed by using a push-pin (not shown) which is used for raising the louver element and removing a mould from the plate fin 16.

Figure 4:
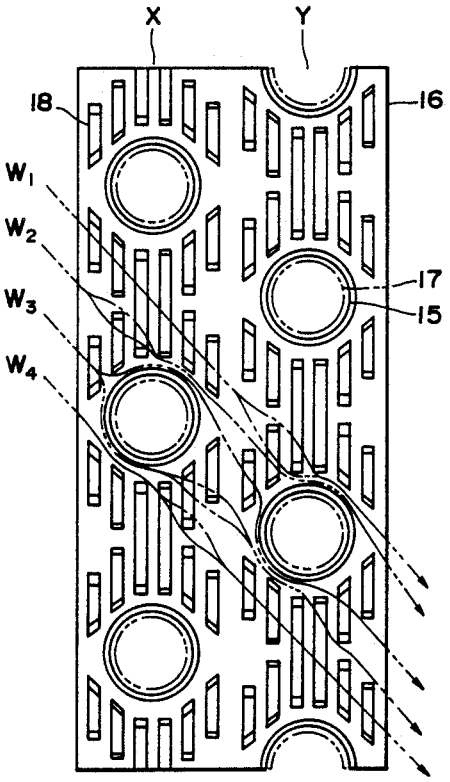
FIG. 4 is an enlarged view of the upper portion of the heat exchanger.

Accordingly, as referred to in the description with reference to FIG. 1, the air streams passing through the upper portion A of the heat exchanger 7 in the diagonally downward direction flow as shown by chain lines in FIG. 4. In an upstream tube row section X, an air stream $W_1$ flowing into the upper divisional louver element 18-3 in the outside row from a position diagonally above the same advances linearly in the diagonally downward direction through the upper divisional louver element 18-5 in the inside row, the central louver elements 18-1, 18-2, the lower divisional louver element 18-8 in the inside row and the lower divisional louver element 18-10 in the outside row in the described order as the divisional louver elements 18-3, 18-5, 18-8, 18-10 of the same length $l_2$, $l_4$ in the inside and outside rows are arranged linearly in the diagonally downward direction with the central louver elements 18-1, 18-2 taking a middle position among these louver elements. The air stream then flows into a downstream tube row section Y and between the divisional louver elements 18-3, 18-4 in the outside row along the surface of the base portion 20-1 to the central louver element 18-6 and the space on the base portion 20-2 between this louver element 18-6 and the divisional louver element 18-5 thereabove, the air stream then flowing along the upper surface of the heat transfer tube 17-4. Thus, in the downstream tube row section Y, the air stream $W_1$ flows through only a small number of louver elements 18-6, 18-1 to complete its substantially linear passage through the heat exchanger 7.

In the upstream tube row section X, an air stream $W_2$ flowing thereinto from a position diagonally above the same and along the base portion 20-1, which is between the divisional louver elements 18-3, 18-4 in the outside row, of the plate fin advances to the central louver element 18-1 through the lower divisional louver element 18-6 in the inside row and the space on the base portion 20-2 of the plate fin which is between this louver element 18-6 and the divisional louver element 18-5 just above the same. The air stream then flows from the upper surface of the heat transfer tube 17-2 to the space on the base portion 20-5 of the fin which is between the divisional louver elements 18-10, 18-9 in the outside row. The air stream then flows into the space in the downstream tube row section Y to advance from the space on the base portion 20-1 between the divisional louver elements 18-3, 18-4 in the outside row to the lower divisional louver element 18-6 in the inner row and then along the upper surface of the heat transfer tube 17-4. Thus, the air stream $W_2$ flows through only the louver elements 18-6, 18-1 in the upstream tube row section X, and through only the louver element 18-6 in the downstream tube row section Y, to complete its substantially linear passage through the heat exchanger 7.

In the upstream tube row section X, an air stream $W_3$ flowing into the lower divisional louver element 18-4 in the outside row from a position diagonally thereabove advances along the upper and lower surfaces of the heat transfer tube 17-2. The stream flowing along the upper surface of this tube advances along the surface of the base portion 20-5 of the plate fin which is between the divisional louver elements 18-4, 18-3 in the outside row, while the stream flowing the lower surface of the same tube 17-2 advances through the upper divisional louver element 18-7 in the inside row and then through the upper divisional louver element 18-9 in the outside row and the space on the base portion 20-5 of the plate fin which is between the divisional louver element 18-4 and the divisional louver element 18-3 just below the louver element 18-4. The air stream then flows into the downstream tube row section Y. One stream flowing through the upper divisional louver element 18-4 in the outside row advances along the lower surface of the heat transfer tube 17-4 and then through the upper divisional louver element 18-7 in the inside row and the space on the base portion 20-4 of the plate fin which is between the divisional louver elements 18-9, 18-10 in the outside row. The stream, in the structure of FIG. 8 of another embodiment, advances further along the root portion of the projections 30. Referring back to FIGS. 1–7, the other stream flows through the space on the base portion 20-5 of the plate fin which is between the divisional louver elements 18-4, 18-3 in the outside row of the heat transfer tube 17-4, and thereafter advances through the divisional louver element 18-2, the space on the base portion 20-3 of the plate fin which is between the divisional louver elements 18-7, 18-8 in the inside row and the space on the base portion 20-4 of the plate fin which is between the divisional louver elements 18-9, 18-10 in the outside row. Thus, the air stream $W_3$ flows through the louver elements 18-4, 18-7 18-9 only in the upstream tube row section X and the louver elements 18-4, 18-2, 18-7 only in the downstream tube row section Y to complete its passage through the heat exchanger 7.

In the upstream tube row section X, an air steam $W_4$ flowing into the heat exchanger along the base portion 20-5 of the plate fin which is on the outer side of the heat transfer tube 17-2 advances along the lower surface of the heat transfer tube 17-2 and through the central louver element 18-2 to separate into two streams one of which flows through the upper divisional louver element 18-7 in the inside row, and the other of which flows through the space on the base portion 20-4 of the plate fin which is between the louver element 18-7 and the divisional louver element 18-8 just below the same louver element 18-7. The air stream then flows through the space on the base portion 20-4 of the plate fin which is between the divisional louver element 18-9, 18-10 in the outside row. The air stream $W_4$ then flowing into the downstream tube row section Y advances linearly through the upper divisional louver element 18-3 in the outside row, the upper divisional louver element 18-5 in the inside row, the central louver elements 18-1, 18-2, the central louver elements 18-8 in the inside row and the lower divisional louver elements 18-10 in the mentioned order since the divisional louver elements 18-3, 18-5, 18-8, 18-10 of the same length $l_2$, $l_4$ in the outside and inside rows are arranged linearly in the diagonally downward direction with the central louver elements taking a middle position among these louver elements. In the upstream tube row section X, the air stream $W_4$ thus flows through the louver elements 18-2, 18-7 only. This air stream flows in the substantially linear direction through the heat exchanger 7.

Figure 5:
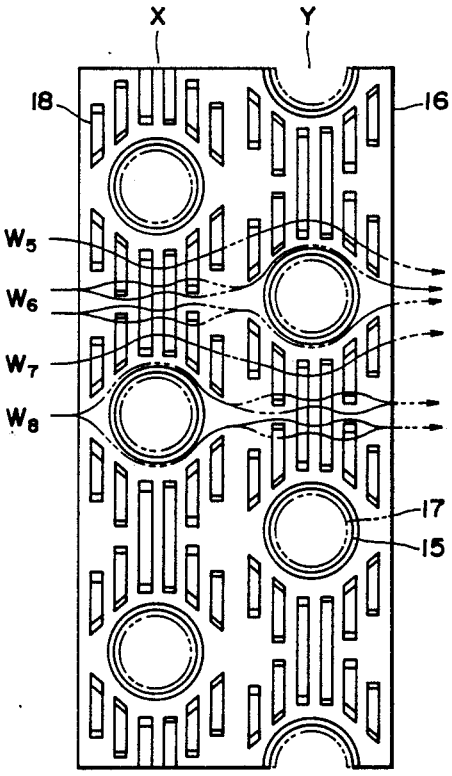
FIG. 5 is an enlarged view of the central portion of the heat exchanger.

As referred to in the above description with reference to FIG. 1, the air stream flowing in the substantially horizontal direction through the central portion B of the heat exchanger 7 advance as shown by chain lines in FIG. 5. In the upstream tube row section X, an air stream $W_5$ flowing horizontally into the upper divisional louver element 18-8 in the outside row advances through the upper divisional louver element 18-5 in the inside row, the central louver elements 18-1, 18-2, the upper divisional louver element 18-7 in the inside row and the upper divisional louver element 18-9 in the outside row. The air stream then flows into the downstream tube row section Y and advances through the lower divisional louver element 18-4 in the outside row, the lower divisional louver element 18-6 in the inside row, the central louver elements 1--1, 18-2, the lower divisional louver element 18-8 in the inside row and the lower divisional louver element 18-10 in the outside row in the described order. The air stream $W_5$ flows through all of the louver elements, which are positioned in the direction of the flow of the air stream, in the upstream and downstream tube row section X, Y to complete its meandering passage through the heat exchanger 7.

In the upstream tube row section X, an air stream $W_6$ flowing into the heat exchanger in the horizontal direction along the surface of the base portion 20-1 of the plate fin which is between the divisional louver elements 18-3, 18-4 in the outside row separates into two streams at the root portions 21, 21 of the divisional louver elements 18-5, 18-6 in the inside row, advances through the central louver elements 18-1, 18-2, separates again into two streams at the root portions 21, 21 of the divisional louver elements 18-7, 18-8 in the inside row and flows through the space on the base portion 20-3 of the plate fin which is between the divisional louver elements 18-7, 18-8 in the inside row, and flows through the space on the base portion 20-4 of the plate fin which is between the divisional louver elements 18-9, 18-10 in the outside row. The air streams when flow into the space between the divisional louver elements 18-4, 18-3 in the outside row in the downstream tube row section Y along the base portion 20-5 of the fin while reducing the distance between these streams, and the resultant air stream separates into streams, which flow along the upper and lower surfaces of the heat transfer tube 17-8. The air stream $W_6$ thus passes in a meandering manner through the heat exchanger 7.

An air stream $W_7$ flowing horizontally into the lower divisional louver element 18-4 in the outside row in the upstream tube row section X passes through the heat exchanger so that the locus of this air stream has vertically symmetric relation with that of the above-mentioned air stream $W_5$. Namely, the air stream $W_7$ flows through the divisional louver element 18-6 in the inside row, the central louver elements 18-1, 18-2, the divisional louver element 18-8 in the inside row, and the divisional louver element 18-10 in the outside row in the described order. The air stream then flows into the downstream tube row section B and advances through the upper divisional louver element 18-3 in the outside row, the divisional louver element 18-5 in the inside row, the central louver elements 18-1, 18-2, the divisional louver element 18-7 in the inside row, and the divisional louver element 18-9 in the outside row in the described order. The air stream $W_7$ thus flows through all of the louver elements, which are positioned in the direction of the air stream, in the upstream and downstream tube row sections X, Y in the same manner as the air stream $W_5$, to complete its meandering passage through the heat exchanger 7.

In the upstream tube row section X, an air stream $W_8$ flowing into the heat exchanger along the base portion 20-5 of the fin which is on the outer side of the heat transfer tube 17-2 advances so that the locus of this air stream has a horizontally reversed symmetric relation with that of the air stream $W_5$ described above. Namely, this air stream separates at the heat transfer tube 17-2 into streams which advance along the upper and lower surfaces of the same tube and then through the space on the base portion 20-5 of the plate fin which is between the divisional louver elements 18-10, 18-9 in the outside row. The air stream then flows into the space on the base portion 20-1 of the plate fin which is between the divisional louver elements 18-3, 18-4 in the outside row in the downstream tube row section Y, separates into streams at the root portions 21, 21 of the divisional louver elements 18-5, 18-6 in the inside row, advances through the central louver elements 18-1, 18-2, separates again into the streams at the root portions 21, 21 of the divisional louver elements 18-7, 18-8 in the inside row and flows through the base portion 20-4 of the fin which is between the divisional louver elements 18-9, 18-10 in the outside row. Thus, the air stream $W_8$ passes in a meandering manner as the air stream $W_6$ through the heat exchanger 7.

In the embodiment of FIG. 8, the twice-divided turbulent air stream $W_8$ is then rectified by the projections provided at the flow-out end portion of the plate fin 16 (FIG. 3) with the result that generation of swirling motion of the air stream is restricted. Thus, generation of noise due to such swirling motion against a cross flow fan 8 can be prevented.

As described above, the locusts of the main air stream $W_1$, $W_2$, $W_4$ flowing through the upper portion A of the heat exchanger 7 in the diagonally downward direction are substantially linear. These air streams do not flow through some louver elements formed in the upstream and downstream tube row sections X, Y and having large air resistances, and they flow through the spaces on the base portions of the plate fin which are between the divisional louver elements in the outside and inside rows, and which have small air resistances. The main air streams $W_5$, $W_7$ entering the central portion B of the heat exchanger 7 in the horizontal direction pass therethrough in a meandering manner. These air streams flow through all of the louver elements arranged in the direction of the flow of the air in the upstream an downstream tube row sections X, Y and having large air resistances. All of the air streams included $W_3$, which passes through the upper portion A of the heat exchanger 7 in the diagonally downward direction, and the air streams $W_6$, $W_8$ which pass through the central portion B of the heat exchanger 7 in the horizontal direction, collide with the heat transfer tubes to flows in a separated state to the upper and lower sides of the tubes and then turn to the downstream side of the tubes, so that these air streams $W_3$, $W_6$, $W_8$ and have large air resistances. The air streams $W_6$, $W_8$ separate twice at the root portions 21 of the divisional louver elements in the inside rows to flow in a meandering manner, and the distance $l_5$ between the divisional louver elements in the outside rows is set smaller than that $l_3$ between the divisional louver elements, which are adjacent to the above louver elements in the outside row and in another tube row, whereby these air streams $W_6$ and $W_8$ have proper air resistance.

Given that the upper portion A of the heat exchanger 7 is farther away from the cross flow fan 8 than the central portion B thereof, the velocities of flow of the air streams $W_1$, $W_2$, $W_3$, and $W_4$ in the upper portion A are lower than those of the air streams $W_5$, $W_6$, $W_7$, and $W_8$ in the central portion B. However, since the air resistances of the air streams $W_1$–$W_4$ are smaller than those of the air streams $W_5$–$W_8$ as discussed above, the heat exchange efficiency in the upper portion A of the heat exchanger can also be improved even when the rotational speed of the cross flow fan 8 is reduced to such a level that can prevent noise from occurring.

Figure 3:
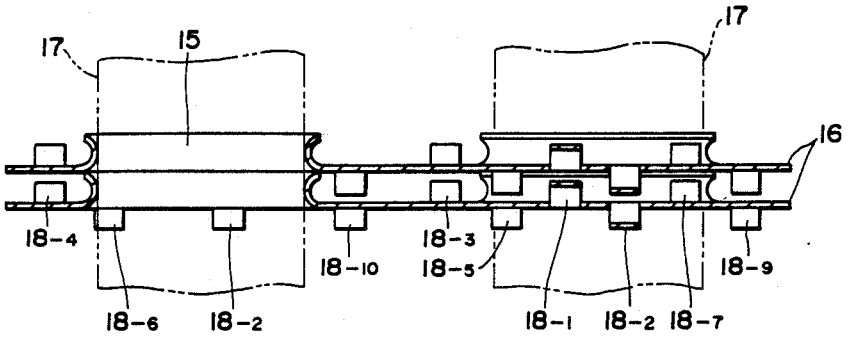
FIG. 3 is a sectional view taken along the line III—III in FIG. 2.

Moreover, the louver elements 18 are cut and raised from the front and rear surfaces alternately of the plate fin 16 so that the louver elements are arranged in the direction of the flow of the air streams as shown in FIG. 3. Therefore, the air streams $W_1$–$W_8$ passing through the upper and central portions A, B flow among the plate fins 16 as they branch and meet repeatedly due to the louver elements, so that the heat exchange efficiency is improved. In addition, the length of the divisional louver elements 18-3, 18-4, 18-9, 18-10 in the outside rows, which are farthest away from the center lines $X_1$, $Y_1$ of the rows of the heat transfer tubes 17, and which have a low heat transfer rate, is reduced so that this length becomes equal to that of the divisional louver elements 18-5, 18-6, 18-7, 18-8 in the inside rows. Accordingly, the heat transfer rate of the louver elements in these outside rows is improved correspondingly to the portion of the length thereof which is cut off.

Figure 6:
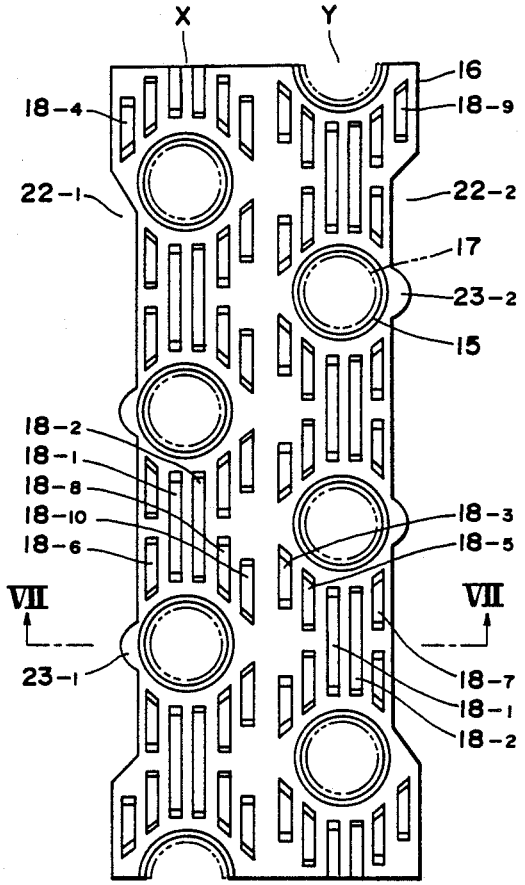
FIG. 6 is an enlarged view of the lower portion of the heat exchanger.

In the embodiment of FIGS. 1–7, the lower portion C of the heat exchanger 7 is positioned close to the cross flow fan 8 so as to reduce the depth of the air conditioner 1. Therefore, the recesses 22-1, 22-2 are cut with the divisional louver elements 18-3, 18-4, 18-9, 18-10 in the outside rows in the portions of the plate fins 16 which are close to the cross flow fan 8, in such a manner that the recesses 22-1, 22-2 shunt the tube-inserting bores 15, as shown in FIG. 6. In the lower portion C, in which these recesses 22-1, 22-2 are provided, of the heat exchanger 7, the velocity of flow of the air stream is highest because the lower portion C is closest to the cross flow fan 8. In order to reduce this velocity of flow and prevent the occurrence of noise, the air resistance of the fins is increased by providing the fins with projections 23-1, 23-2 which are formed by cutting the fins with the portions thereof which are around the tube-inserting-bores 15 left not cut as mentioned above, and also the edge portions 24-1, 24-2 of each plate fin 16 which face the recesses 22-1, 22-2 are bent to a length smaller than the pitch of the fins 16 and extend at right angles to the direction of a flow of the air as shown in FIG. 7, to further increase the air resistance of the fins. The recess 22-1 is formed simultaneously with the recess 22-2, which is formed in the plate fin 16 by molding using a metal mold, but it is not strictly necessary.

Edge portions (not shown), which are bent to a length smaller than the length to which the edge portions 24-1, 24-2 provided in the lower portion C of the heat exchanger 7 are bent may also be provided in the upper and central portions A, B thereof in accordance with the distribution of the velocity of flow of the air in the heat exchanger 7.

In the above embodiment, each of the louver elements 18 is formed by cutting a fin and raising the cut portion to the shape of a bridge. This louver element may also be formed by cutting the fin and raisin the cut portion to the shape of a slat of a Venetian shutter.

In the embodiment of FIG. 8, the projections 30 are shown to be formed along a substantial length of the side portion of the plate fin 16, but provision of the projections at only the central portion B and the lower portion C can also prevent generation of noise since the central and lower portions B, C are closely located to the cross flow fan 8. Further, the projections 30 can be provided at an flow-in portion of the central and lower portions B, C where the velocity of the air stream flowing therethrough is rather high so that an a resistance to air stream is increased.

The present invention which is constructed as described above has the following effects.

The length of the divisional louver elements in the outside row, the distance between these divisional louver elements, and the length of the divisional louver elements in the inner row are set substantially equal, and the louver elements in the outside and inside rows are arranged linearly in the diagonal direction with the central louver elements positioned in the middle of these louver elements. Such linearly arranged louver elements in the upstream tube row section and the corresponding louver elements in the downstream tube row section are staggered vertically from one another by the above-mentioned distance. Accordingly, the locusts of the main air streams passing in the diagonal direction through the upper portion of the heat exchanger become substantially linear. These air streams do not flow through some of the louver elements which have a large air resistance; they flow through the spaces, which have a small air resistance, between the divisional louver elements in the outside and inside rows. On the other hand, the locuses of the main air steams passing horizontally through the central portion of the heat exchanger meander, and these air streams flow through all the louver elements having a large air resistance. Therefore, the air resistance in the upper portion of the heat exchanger is smaller than that in the central portion thereof. Accordingly, even when the velocity of flow of the air stream is reduced to such a level that prevents noise from occurring, the heat exchange efficiency can be improved even in the upper portion of the heat exchanger.

Moreover, given that the length of the divisional louver elements in the outside rows, which have a low heat transfer rate, is set as small as that of the divisional louver elements in the inside rows, the heat transfer rate of the louver elements in the outside rows can be improved.

Further, the projection 30 in the embodiment of FIG. 8 can rectify a main air stream of high velocity which is likely to cause a swirling motion, with the favorable result of restricting generation of noise.

The present invention is not, of course, limited to the above embodiment; it may be modified in various ways within the scope of the appended claims.

What is claimed is:

1. A heat exchanger comprising a plurality of plate fins in each of which tube inserting bores are arranged in a staggered manner, and heat transfer tubes inserted through said bores, a plurality of portions of each of said fins which are between said tubes being cut doubly to a small width and raised so as to form louver elements projecting in a direction which crosses the direction of a flow of the air stream, wherein the root portions of said louver elements are positioned in the portions of each plate fin which are around the inserted portions of said heat transfer tubes, said louver elements comprising central louver elements provided close to a center line connecting the centers of a row of heat transfer tube, and a plurality of rows of divisional louver elements provided on the right and left sides of said central louver elements with base portions left on the regions of said plate fin which are on a line crossing said center line, and wherein the length of said divisional louver elements in outside rows farthest away from said center line is set substantially equal to the distance between said louver elements in each row and the length of said divisional louver elements in inside rows closer to said center line than said outside rows.

2. A heat exchanger according to claim 1, wherein said central louver elements and said divisional louver elements are arranged symmetrically with respect to a bisector extending at right angles to said center line of said row of heat transfer tubes.

3. A heat exchanger according to claim 1, wherein the distance between said divisional louver elements in the outside row provided between adjacent heat transfer tubes in the same tube row is set smaller than the distance between said divisional louver elements in the outside row adjacent to said tube row.

4. A heat exchanger according to claim 1, wherein said louver elements are provided on both surfaces of said plate fins.

5. A heat exchanger according to claim 1, wherein a plurality of projections are formed on the air flow-out portion of said plate fins.

6. A heat exchanger according to claim 1, wherein said plate fins have a recess formed by cutting said fin with said divisional louver elements in the outside row.

7. A heat exchanger according to claim 6, wherein said recess is formed so that said recess shunts bores through which said heat transfer tubes are inserted.

8. A heat exchanger according to claim 6, wherein the edge portions of said plate fins which face said recess are bent in a direction crossing at least the direction of a flow of the air to form a bent portion.

9. A heat exchanger according to claim 8, wherein the length of said bent portion of said fins is set smaller than the distance between two adjacent fins.

* * * * *